US008181716B2

(12) United States Patent
Robson

(10) Patent No.: US 8,181,716 B2
(45) Date of Patent: May 22, 2012

(54) BREAKING MACHINE SHOCK ABSORBING SYSTEM

(75) Inventor: Angus Peter Robson, Matamata (NZ)

(73) Assignee: Terminator IP SA, Luxembourg (LU)

( * ) Notice: Subject to any disclaimer, the term of this patent is extended or adjusted under 35 U.S.C. 154(b) by 16 days.

(21) Appl. No.: 12/517,544

(22) PCT Filed: Dec. 3, 2007

(86) PCT No.: PCT/NZ2007/000353

§ 371 (c)(1),
(2), (4) Date: Dec. 28, 2009

(87) PCT Pub. No.: WO2008/069685

PCT Pub. Date: Jun. 12, 2008

(65) Prior Publication Data

US 2010/0126746 A1 May 27, 2010

(30) Foreign Application Priority Data

Dec. 7, 2006 (NZ) ..... 551876

(51) Int. Cl.
*B25D 17/24* (2006.01)

(52) U.S. Cl. ..... 173/210; 173/90

(58) Field of Classification Search ..... 173/210, 173/211, 162.1, DIG. 2
See application file for complete search history.

(56) References Cited

U.S. PATENT DOCUMENTS 1,220,100 A * 3/1917 Haeseler ..... 173/133
1,690,571 A * 11/1928 Shearman ..... 173/115
1,896,992 A * 2/1933 Agren ..... 173/133
2,308,143 A * 1/1943 Amtsberg et al. ..... 173/211
2,488,279 A * 11/1949 Fitzmaurice et al. ..... 227/147
2,609,813 A * 9/1952 Maurer et al. ..... 173/118
3,566,978 A * 3/1971 Udert ..... 173/211
3,783,970 A * 1/1974 Danielson ..... 181/207
4,211,290 A 7/1980 Mason et al.
4,310,055 A * 1/1982 Wanner et al. ..... 173/118
4,427,078 A * 1/1984 Wolters et al. ..... 173/126
4,548,278 A * 10/1985 Gidlund ..... 173/121
4,924,948 A * 5/1990 Chuang et al. ..... 173/211
5,285,858 A * 2/1994 Okada et al. ..... 173/211

(Continued)

FOREIGN PATENT DOCUMENTS

SU 1812094 A1 4/1993

(Continued)

*Primary Examiner* — Lindsay Low

(74) *Attorney, Agent, or Firm* — Stephen M. De Klerk

(57) ABSTRACT

A breaking apparatus (1) which includes; a housing (3); a striker pin (4) having a driven end and an impact end, locatable in said housing (3) in at least one retaining location to protrude said impact end through the housing (3); a moveable mass (2) for impacting on the driven end of the striker pin (4), and a shock-absorber (7*a, b*) coupled to the retaining locations. The shock-absorber (1) also includes at least two elastic (12) and at least one inelastic (13) layer in a first shock-absorbing assembly (7*a*) located internally within the housing about the striker pin (2) between the retaining location and the striker pin impact end. The shock-absorbing assembly (7*a*) is configured to allow movement of the shock absorber parallel to, or co-axial with the striker pin longitudinal axis during use.

13 Claims, 4 Drawing Sheets

U.S. PATENT DOCUMENTS

| | | | | |
|---|---|---|---|---|
| 5,407,018 | A | 4/1995 | Henry | |
| 5,573,075 | A * | 11/1996 | Henry et al. | 173/211 |
| 6,123,243 | A * | 9/2000 | Pfister et al. | 227/10 |
| 6,135,214 | A * | 10/2000 | Last | 173/211 |
| 6,431,426 | B1 * | 8/2002 | Ehmig | 227/10 |
| 6,457,624 | B1 * | 10/2002 | Weihrauch | 227/10 |
| 7,614,464 | B2 * | 11/2009 | Paasonen | 175/415 |
| 7,628,222 | B2 * | 12/2009 | Yoshimura et al. | 173/162.1 |
| 2004/0231869 | A1 * | 11/2004 | Bernhart et al. | 173/210 |

FOREIGN PATENT DOCUMENTS

| | | |
|---|---|---|
| WO | WO 94/05464 | 3/1994 |

* cited by examiner

BREAKING MACHINE SHOCK ABSORBING SYSTEM

STATEMENT OF CORRESPONDING APPLICATIONS

This is a National Phase of International Application No. PCT/NZ2007/000353, filed on Dec. 3, 2007, which claims priority from New Zealand Patent Application Number 551876 filed on Dec. 7, 2006, the entire contents of which are incorporated herein by reference.

TECHNICAL FIELD

The present invention relates generally to breaking machine shock absorber systems, and in particular shock absorber systems for gravity drop hammer breaking machines.

BACKGROUND ART

Gravity drop hammers, such as described in the applicant's own prior patent applications PCT/NZ93/00074 and PCT/NZ2006/000117 are primarily utilised for breaking exposed surface rock. These hammers generally consist of a striker pin which extends outside a nose piece positioned at the end of a housing which contains a heavy moveable mass. In use, the lower end of the striker pin is placed on a rock and the moveable mass subsequently allowed to fall under gravity from a raised position to impact onto the upper end of the striker pin, which in turn transfers the impact forces to the rock.

Elevated stress levels are generated throughout the entire hammer apparatus and associated supporting machinery (e.g. an excavator, known as the carrier) by the high impact forces associated with such breaking actions. PCT/NZ93/00074 discloses an apparatus for mitigating the impact forces from such operations by using a unitary shock absorbing means in conjunction with a retainer supporting a striker pin within the nose piece.

The unitary shock absorbing means is a block of at least partially elastic material which compresses under the impact force of the moveable mass on the striker pin. The striker pin attachment to the nose piece is configured with a small degree of allowable travel constrained by a pair of retaining pins fitted to the retainer and allowing movement along the longitudinal striker pin axis via recesses formed into the sides of the striker pin.

Despite the advantages of the system described in PCT/NZ93/00074, there is an ongoing desire to further attenuate the effects of impact forces on the device and/or reducing the device weight, to allow the use of a smaller carrier. Such improvements also result in reduction in wear and associated maintenance requirements.

All references, including any patents or patent applications cited in this specification are hereby incorporated by reference. No admission is made that any reference constitutes prior art. The discussion of the references states what their authors assert, and the applicants reserve the right to challenge the accuracy and pertinency of the cited documents. It will be clearly understood that, although a number of prior art publications are referred to herein, this reference does not constitute an admission that any of these documents form part of the common general knowledge in the art, in New Zealand or in any other country.

It is acknowledged that the term 'comprise' may, under varying jurisdictions, be attributed with either an exclusive or an inclusive meaning. For the purpose of this specification, and unless otherwise noted, the term 'comprise' shall have an inclusive meaning—i.e. that it will be taken to mean an inclusion of not only the listed components it directly references, but also other non-specified components or elements. This rationale will also be used when the term 'comprised' or 'comprising' is used in relation to one or more steps in a method or process.

It is an object of the present invention to address the foregoing problems or at least to provide the public with a useful choice.

Further aspects and advantages of the present invention will become apparent from the ensuing description which is given by way of example only.

DISCLOSURE OF INVENTION

According to one aspect of the present invention there is provided a breaking apparatus which includes;

a housing;

a striker pin having a driven end and an impact end, locatable in said housing in at least one retaining location to protrude said impact end through the housing;

a moveable mass for impacting on said driven end of the striker pin, and a shock-absorber coupled to said retaining locations, characterised in that said shock-absorber includes at least two elastic and at least one inelastic layer in a first shock-absorbing assembly located internally within said housing about the striker pin between said retaining location and said striker pin impact end, said shock-absorbing assembly being configured to allow movement of the shock absorber parallel to, or coaxial with the striker pin longitudinal axis during use.

Preferably said breaking apparatus further includes a second shock-absorbing assembly located internally within said housing about the striker pin between said retaining location and said striker pin driven end.

Preferably, the striker pin is locatable in the housing in a retaining location by a retainer interposed between two shock-absorbing assemblies located along, or parallel to, the striker pin longitudinal axis.

A first shock-absorbing assembly is located between the retainer and the striker pin tip and a second shock-absorbing assembly is located between the retainer and the end of the striker pin onto which the moveable mass impacts. The second shock-absorbing assembly is able to attenuate motion of the pin when rebounding following an unsuccessful strike, i.e. where the rock does not break and some of the impact energy of the striker pin is reflected into the hammer in a reciprocal direction as a recoil force.

As used herein, the term 'retaining location' refers to a location in a fixed range of striker pin longitudinal travel allowable during use in impacting operations. The striker pin is preferably configured with some form of moveable or slideable attachment to the breaking apparatus housing to allow the impulse of the impact by the moveable mass to be transmitted through the striker pin to the work surface without transmitting any appreciable force to the breaking apparatus housing and/or mounting.

The term 'coupled' as used herein includes any configurations where the movement of said retaining locations, relative to the housing is at least partially transmitted to the shock-absorber.

Thus, in preferred embodiments the striker pin may be attached to the breaking apparatus at a retaining location by a slideable coupling, allowing the striker pin a degree of longitudinal travel during impacting operations, and also providing, with respect to said driven end, a distal and preferably also a proximal travel limit for the striker pin.

Preferably, said retainer substantially encircles the striker pin and includes at least part of said slideable coupling and one or more retaining pins passing through the retainer body and at least partially protruding into longitudinal recesses on the breaking apparatus housing exterior or striker pin. The longitudinal recesses are preferably located on the striker pin and herein reference will be made to same though this should not be seen to be limiting.

As in prior art breakers, the slideable coupling may be formed from at least one releasable retaining pin which can be inserted into either the striker pin or the walls of the housing adjacent the striker pin (i.e. the nose block), such that the pin or pins partially protrude into a corresponding indent or recess in the striker pin or housing walls.

The indent typically extends parallel to the striker pin longitudinal axis for a distance defining the allowable striker pin travel during impact operations before the retaining pin engages with the longitudinal ends of the indent. Thus, together with the length of the striker pin, the position and length of the indent and the position of the releasable retaining pin(s) defines the maximum and minimum extent to which the striker pin protrudes from the housing. The proximal indent stop (i.e. that closest to the moveable mass) is required to prevent the striker pin from falling out of the breaker, whilst the distal stop prevents the striker pin from being pushed completely inside the housing when an operator positions the breaker in the priming position.

The striker pin is in a primed position when ready to receive and transmit the impact from the moveable mass to the work surface and the retaining pin is at the end of the indent closest to the work surface. This is caused as a consequence of positioning the breaker tip as close to the working surface as the striker tip will allow, thereby priming the striker pin by forcing it into the housing until being restrained by the retaining pin(s) engaging with the proximal indent stop, i.e. the upper extent of the indent furthest from the work surface.

When the moveable mass is dropped onto the striker pin, the striker pin is forced into the work surface until it is prevented from any further movement by the retaining pin meeting the other end of the indent closest to the moveable mass.

According to one embodiment, at least one said elastic and/or inelastic layer is substantially annular and concentric about the striker pin longitudinal axis. Thus, during impact operations when the retaining pin(s) are forced into engagement with either the lowermost or uppermost extent of the retaining location indent, any remaining striker pin momentum is transferred to the shock-absorbing system by compressing the elastic layer(s).

As used herein, the elastic layer may be formed from any material with a Young's Modulus of less than 30 Gigapascals, while said inelastic layer is defined as including any material with a Young's Modulus of greater than 30 GPa. (and preferably greater than 50 GPa) It will be appreciated that such a definition provides a quantifiable boundary to classify materials as elastic or inelastic, though it is not meant to indicate that the optimum Young's Modulus necessarily lies close to these values. Preferably, the Young's modulus of the inelastic and elastic layer is $>180\times10^9$ N/m$^2$ and $<3\times10^9$ Nm$^{-2}$ respectively.

Preferably, the inelastic material is formed from steel plate (typically with a Young's modulus of 200 GPa) or similar material capable of withstanding the high stresses and compressive loads and preferably exhibiting a relatively low degree of friction. The elastic material may be selected from a variety of such materials exhibiting a degree of resilience, though polyurethane (with a Young's modulus of approximately $0.025\times10^9$ Nm$^{-2}$) has been found to provide ideal properties for this application.

During compressive loads, rubber materials and the like may reduce in volume and/or display poor heat, resilience, load and/or recovery characteristics. However, an elastomer such as polyurethane is essentially an incompressible fluid and thus tries to alter shape (not volume) during compressive loads, whilst also displaying desirable heat, resilience, load and recovery characteristics. Thus, by forming the elastomer into a layer constrained on opposing substantially parallel planar sides by a rigid/non-elastic layer, a compressive force applied substantially orthogonal to the plane of the constrained layers causes the elastomer to expand laterally. The degree of lateral deflection depends on the empirically derived 'shape factor' given by the ratio of the area of one loaded surface to the total area of unloaded surfaces free to expand.

Using substantially planar elastomer layers between parallel inelastic plates causes the elastomer surfaces in contact with the plates to spread laterally, effectively increasing the effective load bearing area. It has been determined that a shock-absorbing assembly of multiple steel plates, interleaved between layers of polyurethane provides an effective configuration to allow each polyurethane layer to expand laterally under compressive load by approximately 30% without detrimental effect, whilst providing far greater compressive strength than could be achieved with a single unitary piece of elastic material.

As volume in the hammer nose housing is at a premium, it is important to maximise the volumetric efficiency of the nose piece components such as the shock absorber layers. Using multiple thin layers instead of a single thicker layer with the same overall volume provides a high load capacity while only subjecting the individual elastic layers to a manageable degree of deflection. As an example, two separate layers of polyurethane of 30 mm, deflecting 30%, i.e. 18 mm possesses twice the load bearing capacity of a 60 mm layer deflecting 18 mm. This provides significant advantages over the prior art. In tests, the present invention has been found to withstand twice the load of a comparable shock absorber with a single unitary elastic layer, allowing twice the shock load to be arrested by the shock-absorber in the same volume of the hammer nose block. The degree of deflection is directly proportional to the change in thickness of the elastic layer, which in turn affects the deceleration rate of the movable mass; the smaller the change in overall thickness, the more violent the deceleration. Thus, using several thinner layers of elastic material also enables the deceleration rate of the movable mass to be tailored effectively for the specific parameters of the hammer, which would be impractical with a single unitary elastic component.

Variations in the load surface conditions cause significant consequential variations in the stiffness of the elastic layer, e.g. a lubricated surface offers virtually no resistance to lateral movement, a clean, dry loading surface provides a degree of friction resistance, while bonding the elastic material to the inelastic material prevents lateral movement at the loading surface and further increases the compressive strain and load bearing capabilities.

As discussed, the volume of space inside the hammer housing nose piece is limited and consequentially any space savings allow either a weight reduction and/or stronger, more capable components to be fitted with a consequential improvement in performance. The present invention for example may allow a sufficient weight saving (typically 10-15%) in the hammer nose block to allow a lighter carrier to be used for transport/operation. Given the reduction from a 36 tonne carrier (used for typical prior art hammers) to a 30 tonne carrier offers a purchase saving of approximately. NZ$80,000, in addition to increased efficiencies in reduced operational and maintenance costs. Transporting a 36 tonne carrier is also an expensive and difficult burden for operators compared to a 30 tonne carrier which is far more practical.

It will be appreciated that an elastic layer such as an elastomer, constrained under load between two rigid parallel plates will deflect outwardly. If the elastic layer is configured in a substantially annular configuration laterally surrounding the striker pin, the elastic material will also deflect inward toward the centre of the aperture. This simultaneous movement in opposing lateral directions requires careful management for the shock-absorbing assembly to function successfully. The whole shock-absorbing assembly of elastic and non-elastic plates needs to be free to move parallel or coaxially with the longitudinal axis of the striker pin, and laterally without the elastic layers impinging against the walls of the housing and/or striker pin.

Thus, according to a preferred aspect of the present invention, at least one shock-absorbing assembly is slideably retained within the housing about the striker pin, wherein the housing further includes two or more guide elements arranged on inner walls of the housing and orientated parallel to the longitudinal axis of the striker pin, said guide elements configured to slideably engage with a complementary projection located about the elastic layer periphery.

It will be understood by one skilled in the art that in an alternative embodiment, the guide elements may be located on the exterior of the striker pin. It will also be appreciated that a reverse configuration is also possible with the elastic layer periphery including a recess for sliding engagement with protruding guide elements.

Preferably, said projection is a substantially rounded, or curved-tip triangular configuration, sliding within a complementary elongated shaped guide element groove. Locating, or 'centering' the elastic layers during longitudinal movement caused by shock-absorbing impact is crucial as it prevents the laterally displaced/deflected portions of the elastic layer from impinging on the housing and/or striker pin walls.

During the compressive cycle the edges of the elastic layer are subject to large changes in size and shape. Any sudden geometric discontinuities at the edges are subject to significantly higher stresses than gradual discontinuities, thus the elastic layer is preferably shaped as a smooth annulus without sharp radii, small holes, thin projections and the like as these would all generate high stress concentrations and consequential fractures. This precludes small stabilising features being formed directly on the elastomer layer. Moreover, the elastic layer projections would wear rapidly, or even tear off if the guide elements were formed from a rigid material. Consequently, according to a further aspect, said guide elements are formed from a semi-rigid or at least partly flexible material.

Alternatively, if large stabilising features were formed, they would also fracture along the point of exiting the shock-absorbing assembly. Thus the guide element must be formed separately from the shock absorbing assembly.

At any point where an elastomer such as polyurethane is locally constrained by a rigid surface (i.e. is prevented from expanding in a particular direction), it becomes incompressible at that location and is rapidly destroyed by the intense self generated heat caused by the applied compressive forces. Thus, the elastic layer must always be capable of free or relatively free expansion in at least one direction throughout the compressive cycle. This could be accomplished simply by limiting elastic layer lateral dimensions overly conservatively. However, such an approach does not make efficient use of the available cross-sectional in the hammer nose portion to absorb shock. Thus, it is advantageous to maximise usage of the lateral area available without jeopardising the integrity of the elastic layers. The incorporation of guide elements provides a means of attaining such efficiency. It will be appreciated that although the elastic layer also expands inwardly towards the striker pin, contact with the striker pin is not problematic as the loaded shock-absorbing assembly and the striker pin are moving longitudinally in concert.

In a preferred embodiment, the guide elements are formed from a material of greater resilience (i.e. softer) than the elastic layer. Consequentially, as the elastic layer expands laterally in use under compression and the projection(s) move into increasing contact with the guide elements, two different types interaction mechanism occur. Initially, the projections slide parallel to the longitudinal striker pin axis, until the contact pressure reaches a point where the guide element starts to move in conjunction with the elastic element parallel to the striker pin longitudinal axis. The guide element thus offers minimal abrasive, or movement resistance to the elastic layer projections. Moreover, in addition to preventing the projection becoming locally incompressible, the increased softness of the guide element compared to the elastic layer projections causes the effects of any wear to be predominately borne by the guide element. This reduces maintenance overheads as the guides may be readily replaced without the need to remove and dismantle the shock-absorbing assemblies.

It will thus be appreciated that although the shock absorber may function without guide elements, it is advantageous to do so to maximise the usable volume available to incorporate the largest bearing surface for each elastic layer without interference with the housing and/or striker pin walls.

According to a further aspect of the present invention, the or each projection includes a substantially concave recess at the projection apex. Preferably, said recess is configured as a part-cylindrical section orientated with a geometric axis of revolution in the plane of the elastic layer. Under compressive load, the centre of the elastic layer is displaced outwards by the greatest extent. The recess or 'scoop' of removed material from the projection apex enables the elastic layer to expand outwards without causing the centre of the projection to bulge laterally beyond the elastic layer periphery.

As used herein, the term 'housing' is used to include, but is not restricted to, any portion of the breaking apparatus used to locate and secure the striker pin, including any external casing or protective cover, nose-block portion through which the striker pin protrudes, and/or any other fittings and mechanisms located internally or externally to said protective cover for operating and/or guiding said moveable mass to contact the striker pin, and the like.

The term 'striker pin' refers to any elements acting as a conduit to transfer the kinetic energy of the moving mass to the rock or work surface. Preferably, the striker pin comprises an elongate element with two opposed ends, one end (generally located internally in the housing) being the driving end which is driven by impulse provided by collisions from the moveable mass, the other end being an impact end (external to the housing) which is placed on the work surface to be impacted. The striker pin may be configured to be any suitable shape or size.

Though reference is made throughout the present specification to the breaking apparatus as being a rock breaking apparatus, it should be appreciated that the present invention is applicable to other breaking apparatus.

In preferred embodiments, after being raised, the moveable mass is allowed to fall under gravity to provide impact energy to the driven end of the striker pin. However, it should be appreciated that the principles of the present invention could possibly apply to breaking apparatus having types of powered hammers, for example hydraulic hammers.

The present invention may thus provide one or more of an advantageous combination of improvements in shock-absorbing for impact devices over the prior at including saving manufacturing and operations costs, and improving operating efficiency, without any appreciable drawbacks. It also provides a means for readily optimising the shock absorbing characteristics of a breaking apparatus according to the particular constraints and requirements of the breaking apparatus operation by varying the number and properties of elastic (and inelastic) layers incorporated into the shock absorbing assemblies.

BRIEF DESCRIPTION OF DRAWINGS

Further aspects of the present invention will become apparent from the following description which is given by way of example only and with reference to the accompanying drawings in which.

BEST MODES FOR CARRYING OUT THE INVENTION

Figure 1:
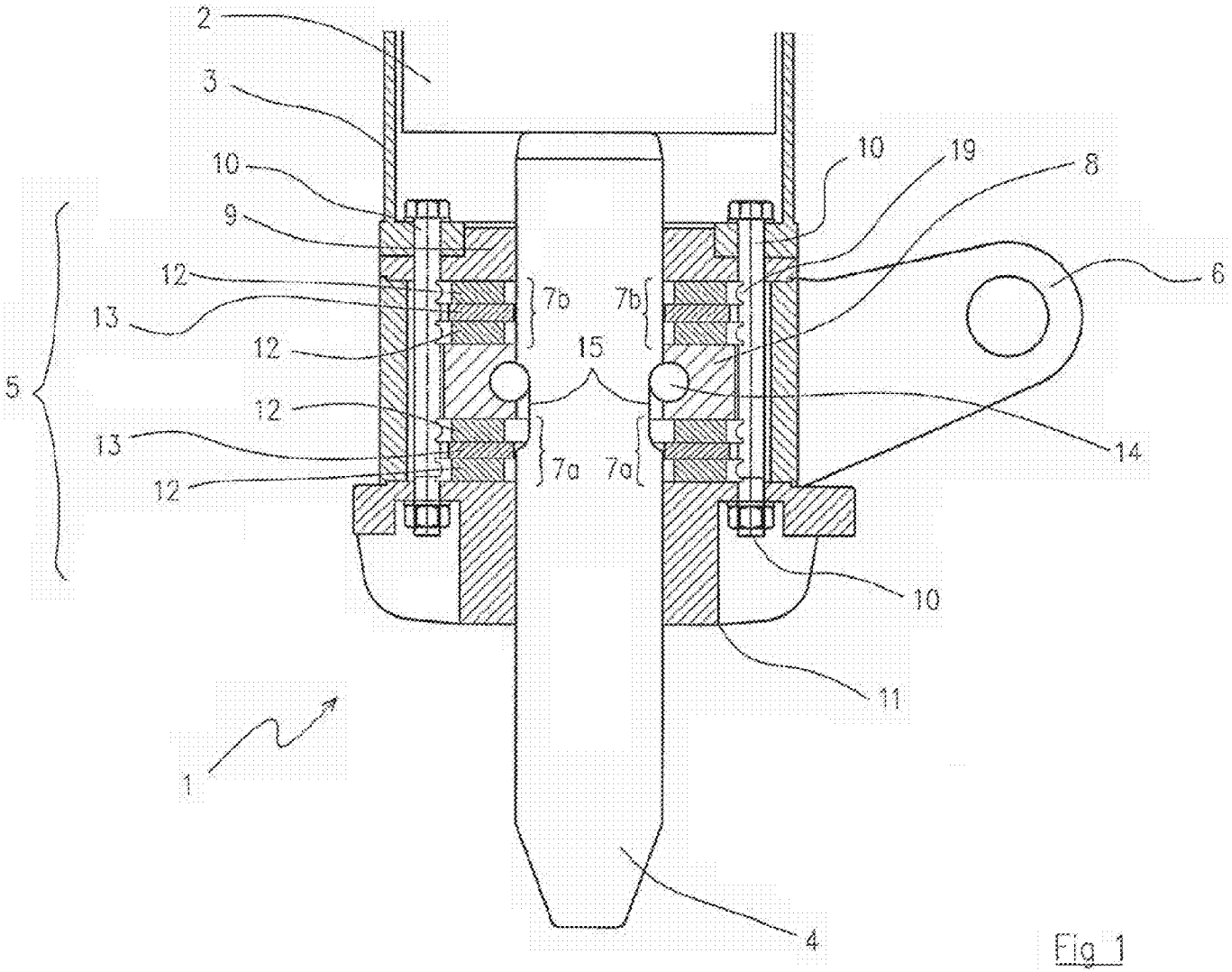
FIG. 1 shows a side elevation in section of a nose assembly for a rock-breaking apparatus in accordance with a preferred embodiment of the present invention.
Figure 2:
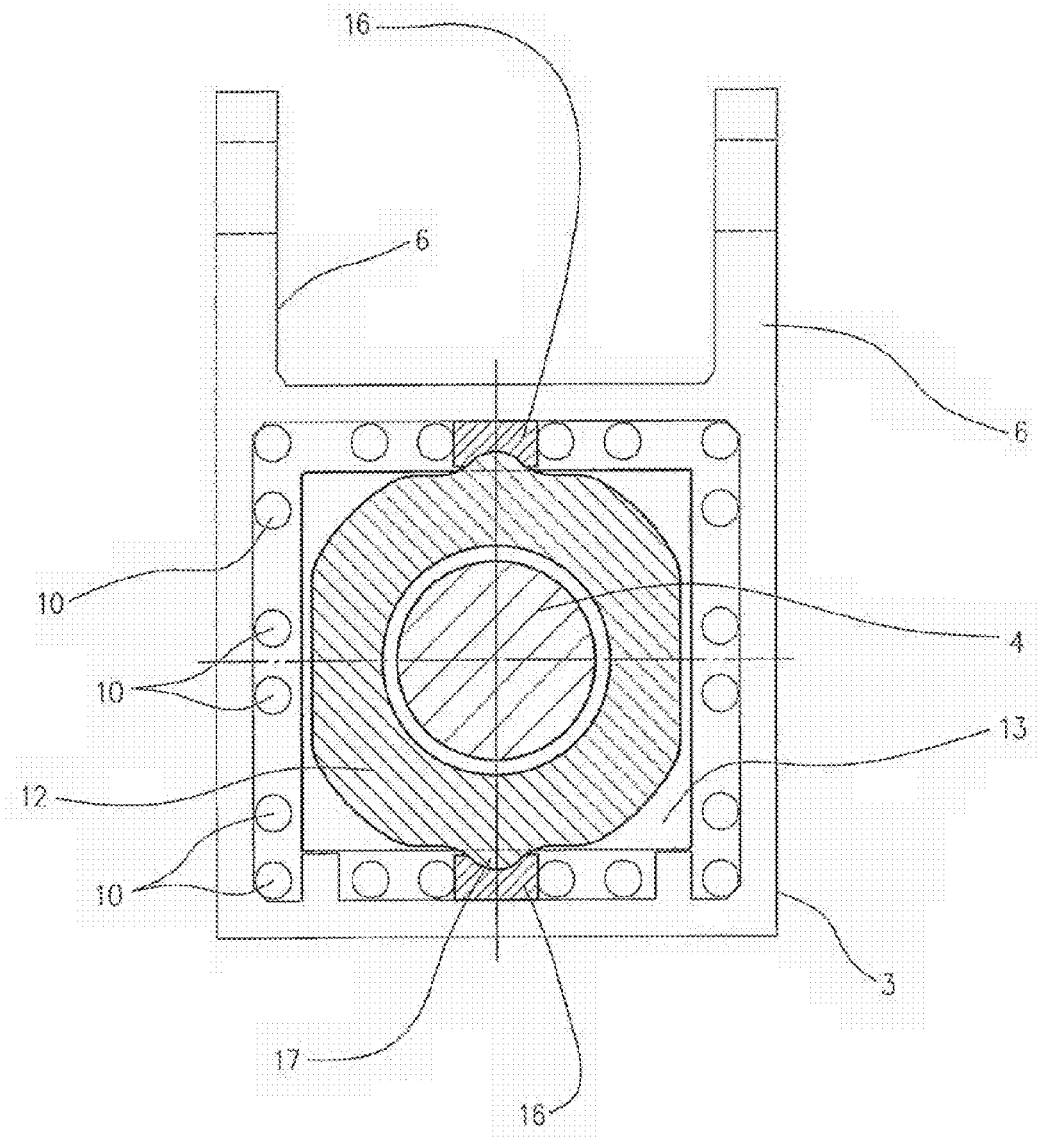
FIG. 2 shows a plan section through the nose assembly of FIG. 1.
Figure 3:
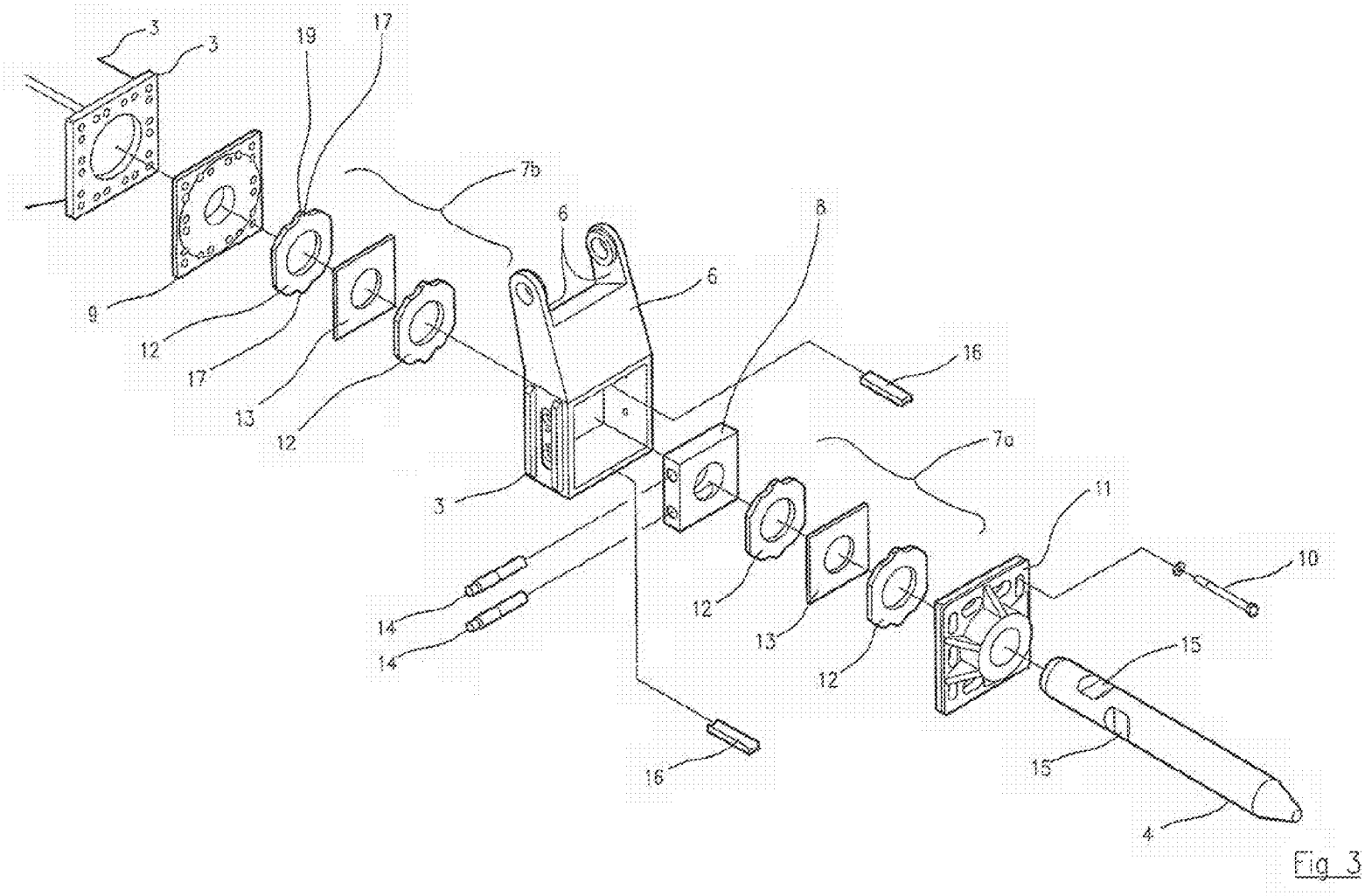
FIG. 3 shows an exploded perspective view of the nose assembly shown in FIGS. 1-2.

A preferred embodiment of the present invention is illustrated by FIGS. 1-3 in the form of a rock-breaking hammer (1) including a moveable mass (2) constrained to move linearly within a housing (3), a striker pin (4) is located in a nose portion (5) of the housing to partially protrude through the housing (3). The striker pin (4) is an elongate substantially cylindrical mass with two ends, i.e. a driven end impacted by the movable mass (2) and an impact end protruding through the housing (3) to contact the rock surface being worked. The housing (3) is substantially elongate, with an attachment coupling (6) (attached to the nose portion (5) at one end of the housing (3)), and used to attach the breaking apparatus (1) to a carrier (not shown) such as a tractor excavator or the like.

The breaking apparatus (1) also includes a shock absorber in the form of first and second shock absorbing assemblies (7*a, b*) laterally surrounding the striker pin (4) within the nose portion (5) and interposed by a retainer in the form of recoil plate (8).

The shock-absorbing assemblies (7*a, b*) and recoil plate (8) are held together as a stack around the striker pin (4) by an upper cap plate (9) fixed, via longitudinal bolts (10) to the nose cone (11) portion of the housing, located at the distal portion of the hammer, through which the striker pin (4) protrudes.

As may be seen more clearly in FIG. 3, the individual shock-absorbing assemblies (7*a, b*) are composed of a plurality of individual layers. In the embodiment shown in FIGS. 1-3, each shock-absorbing assembly (7*a, b*) is composed of two elastic layers in the form of polyurethane elastomer annular rings (12), separated by an inelastic plate in the form of apertured steel plate (13). The shock-absorbing assemblies (7*a, b*) are held in an intimate fit between the cap plate (9) and nose cone (11), though are otherwise unrestrained from longitudinal movement parallel/coaxial to the longitudinal axis of the striker pin (4). Two retaining pins (14) passing laterally through the recoil plate (8) such that a portion partially projects inwardly into an indent (15) formed in the striker pin (4).

The polyurethane rings (12) in each shock-absorbing assembly (7*a, b*) are held in position perpendicular to the striker pin longitudinal axis by guide elements (16), located on the interior walls of the housing (3).

Each polyurethane ring (12) includes small rounded projections (17) extending radially outwards from the outer periphery in the plane of the polyurethane ring (12). The guide elements (16) are configured with an elongated groove shaped with a complementary profile to said projections (17) to enable the shock-absorbing assemblies (7*a, b*) to be held in lateral alignment. This allows the rings (12) to expand laterally whilst preventing the polyurethane rings (12) from impinging on the inner walls of the housing (3), i.e. maintaining the rings (12) centered co-axially to the striker pin (4), thus preventing any resultant abrasion/overheating damage to the polyurethane ring (12).

The guide elements (16) are generally elongate and also formed from a similar elastic material to the elastic layer (12), i.e. preferably polyurethane However, the guide elements (16) are preferably formed from a much softer elastic material, i.e., with a lower modulus of elasticity. This provides two key benefits;

1. The softer guide elements wear more readily than the polyurethane annular rings (12). Consequently, maintenance costs are reduced as the guide elements (16) may be easily replaced when worn and do not require the removal and dismantling of the shock absorbing assemblies (7*a*, 7*b*) in order to replace the annular rings (12)
2. The guide element (16) offers virtually no resistance to the lateral expansion of the annular rings (12) under load, thus avoiding the projections (17) becoming locally incompressible which may lead to failure thereof.

During a shock absorbing process, as the elastomer ring (12) expand laterally, the projections (17) are forced outwards into increasing contact with the guide elements (16) until the pressure reaches a point where the guide element (16) starts to move parallel to the striker pin longitudinal axis in conjunction with the polyurethane ring (12).

As shown most clearly in FIG. 1, each projection (17) includes a substantially concave recess (19) at the projection apex. Each recess (19) is a part-cylindrical section orientated with a geometric axis of revolution in the plane of the elastic layer (12). Under compressive load, the centre of the elastic layer (12) is displaced laterally outwards by the greatest extent. The recess (19) enables the elastic layer (12) to expand outwards without causing the centre of the projection (16) to bulge beyond the periphery of the projection (17).

Figure 4A:
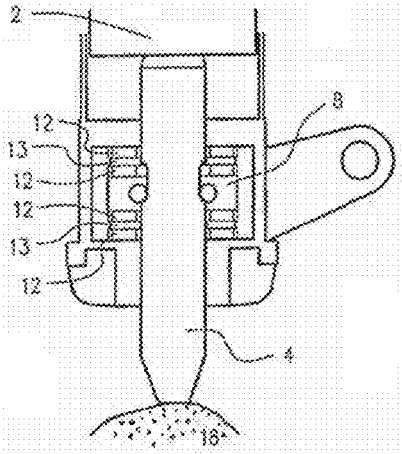
FIGS. 4*a-b*) shows a schematic representation of the breaking apparatus before and after an effective strike.
Figure 4B:
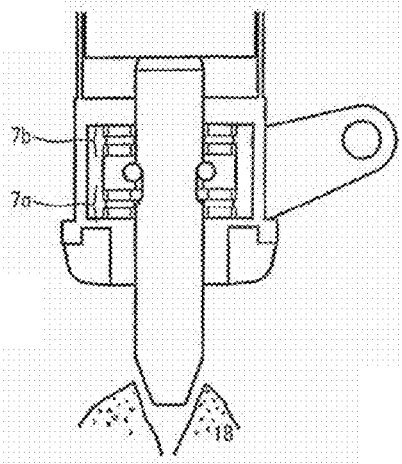

FIGS. 4*a-b*), 5*a-b*) and 6*a-b*) respectively show a breaking apparatus in the form of rock-breaking hammer (1) performing an effective strike, a mis-hit and an ineffective strike, both before (FIGS. 4*a*, 5*a*, 6*a*) and after (FIGS. 4*b*, 5*b*, 6*b*) the moveable mass (2) impacts the striker pin (4).

In typical use (as shown in FIG. 4*a-b*), the lower tip of the striker pin (4) is placed on a rock (18) and the hammer (1) lowered until the retaining pins (14) impinge on the lower stop of the indents (15). This is termed the 'primed' position.

The moveable mass (2) is then allowed to fall onto the upper end of the striker pin (4) inside the housing (3) and the resultant force transferred through the striker pin (4) to the rock (18). When the impact results in a successful fracture of the rock (18), as shown in FIG. 4*b*, virtually all of the impact energy from the moveable mass (2) may be dissipated and little, if any, force is required to be absorbed by either of the shock-absorbing assemblies (7*a, b*).

Figure 5A:
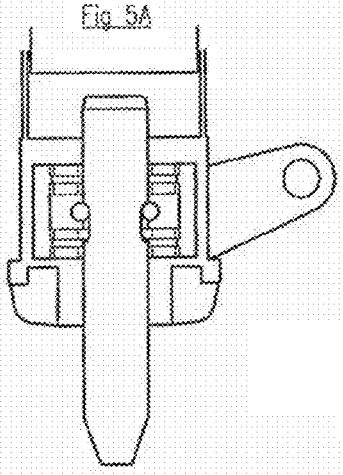
FIGS. 5*a-b*) shows a schematic representation of the breaking apparatus before and after a mis-hit, and FIGS. 6*a-b*) shows a schematic representation of the breaking apparatus before and after an ineffective strike.
Figure 5B:
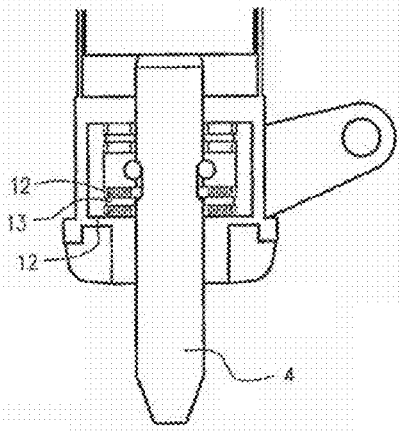

FIGS. 5*a-b*) show the effects of a 'mis-hit' or 'dry hit', in which the moveable mass (2) impacts the striker pin (4) without being arrested by impacting a rock (18) or similar. Consequently, all, or a substantial portion of the impact energy of the moveable mass (2) is transmitted to the hammer (1). The downward force of the moveable mass (2) impacting the striker pin (4) forces the upper ends of the indents (15) in contact with the retaining pins (14) and consequentially apply a downward force to the lower shock absorbing assembly (7*a*) between the recoil plate (8) and the nose cone (11). The compressive force displaces the polyurethane rings (12) laterally orthogonally to the striker pin longitudinal axis in the process of absorbing the impact shock. The steel plates (13) prevent the polyurethane rings from mutual contact, thereby avoiding wear and also maximising the combined shock-absorbing capacity of all the elastic polyurethane rings (12) in the shock absorbing assembly (7*a*) in comparison to use of a single unitary elastic member.

A significant degree of heat is generated in a 'dry hit' though it has been found that even several such strikes successively may avoid permanent damage to the polyurethane rings (12) provided a cooling period is allowed by the operator before continuing impact operations. Ideally, deformation of the polyurethane rings (12) is less than approximately 30% change in thickness in the direction of the applied force, though this may increase to 50% in a dry hit.

Figure 6A:
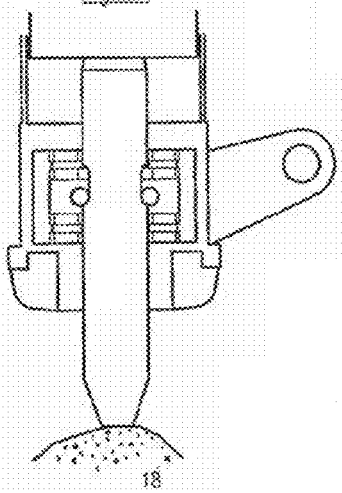
Figure 6B:
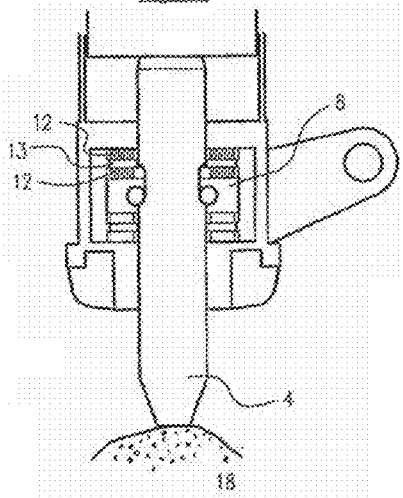

FIG. 6*a-b*) show the effects of an ineffective hit whereby the impact force of the moveable mass (2) on the striker pin (4) is insufficient to break the rock causing the striker pin (4) to recoil into the housing (3) on a reciprocal path. This forces the retaining pins (14) into contact with the lowermost ends of the striker pin recesses (15). Consequently, the upwards force is transferred via the recoil plate (8) to the upper shock absorbing assembly (7*b*) causing the elastic polyurethane rings (12) to deflect laterally during absorption of the applied force. Thus, the shock absorbing assembly (7*b*) mitigates the detrimental effects of the recoil force on the hammer (1) and/or carrier (not shown).

Aspects of the present invention have been described by way of example only and it should be appreciated that modifications and additions may be made thereto without departing from the scope thereof.

What is claimed is:

1. A breaking apparatus including:

a housing;

a striker pin having a driven end and an impact end, locatable in said housing in at least one retaining location to protrude said impact end through the housing;

a moveable mass for impacting on said driven end of the striker pin, and a shock-absorber coupled to said retaining location, characterised in that said shock-absorber includes at least a first and second shock-absorbing assemblies, wherein;

said first shock-absorbing assembly includes at least two elastic and at least one inelastic layer located internally within said housing about the striker pin between said retaining location and said striker pin impact end, said second shock-absorbing assembly being located internally within said housing about the striker pin between said retaining location and said striker pin driven end, both said shock-absorbing assemblies being configured to allow movement of the shock absorber parallel to, or co-axial with the striker pin longitudinal axis during use, at least one shock-absorbing assembly is slideably retained within the housing about the striker pin, the housing includes two or more guide elements arranged on inner walls of the housing and orientated parallel to the longitudinal axis of the striker pin, said guide elements configured to slideably engage with a complementary projection located about an elastic layer periphery.

2. A breaking apparatus as claimed in claim 1, wherein said a second shock-absorbing assembly includes at least two elastic and at least one inelastic layer.

3. A breaking apparatus as claimed in claim 1, wherein the striker pin is locatable in the housing in a retaining location by a retainer interposed between said first and second shock-absorbing assemblies located along, or parallel to, the striker pin longitudinal axis.

4. A breaking apparatus as claimed in claim 1, wherein the striker pin is attached to the breaking apparatus at a retaining location by a slideable coupling, allowing the striker pin a degree of longitudinal travel during impacting operations, and also providing, with respect to said driven end, a distal travel limit for the striker pin.

5. A breaking apparatus as claimed in claim 4, wherein said striker pin attachment to the breaking apparatus at a retaining location by said slideable coupling also provides, with respect to said driven end, a proximal travel limit for the striker pin.

6. A breaking apparatus as claimed in claim 4, wherein a retainer substantially encircles the striker pin and includes at least part of said slideable coupling and one or more retaining pins passing through the retainer body and at least partially protruding into longitudinal recesses on the breaking apparatus housing exterior or striker pin.

7. A breaking apparatus as claimed in claim 1, wherein at least one said elastic and/or inelastic layer is substantially annular about the striker pin longitudinal axis.

8. A breaking apparatus as claimed in claim 1, wherein said projection is a substantially rounded, or curved-tip triangular configuration, sliding within a complementary elongated shaped guide element groove.

9. A breaking apparatus as claimed in claim 1, wherein said guide elements are formed from a semi-rigid and/or at least partly flexible material.

10. A breaking apparatus as claimed in claim 1, wherein said guide elements are formed separately from each said shock absorbing assembly.

11. A breaking apparatus as claimed in claim 1, wherein said guide elements are formed from a material of greater resilience than the elastic layer.

12. A breaking apparatus as claimed in claim 1, wherein the or each projection includes a substantially concave recess at the projection apex.

13. A breaking apparatus as claimed in claim 12, wherein said substantially concave recess is configured as a part-cylindrical section orientated with a geometric axis of revolution in the plane of the elastic layer.

* * * * *